US007007690B1

(12) United States Patent
Grove et al.

(10) Patent No.: US 7,007,690 B1
(45) **Date of Patent: *Mar. 7, 2006**

(54) ADVANCED CHEMICAL/BIOLOGICAL CREW MASK

(75) Inventors: Corey M. Grove, Red Lion, PA (US); Stephen E. Chase, Jarrettsville, MD (US)

(73) Assignee: The United States of America as represented by the Secretary of the Army, Washington, DC (US)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 363 days.

(21) Appl. No.: 09/653,569

(22) Filed: Aug. 31, 2000

(51) Int. Cl.
*A62B 19/00* (2006.01)

(52) U.S. Cl. ..... 128/201.25; 128/206.17; 128/206.26; 128/206.24

(58) Field of Classification Search ..... 128/201.25, 128/206.17, 205.27, 205.25, 205.29, 206.23, 128/206.24, 206.26, 205.28
See application file for complete search history.

(56) References Cited

U.S. PATENT DOCUMENTS

| | | | | | |
|---|---|---|---|---|---|
| 2,199,231 | A | * | 4/1940 | Schwartz | 128/206.17 |
| 2,810,386 | A | * | 10/1957 | Reed | 128/201.15 |
| 2,821,192 | A | * | 1/1958 | Monro | 128/201.15 |
| 2,939,458 | A | * | 6/1960 | Lundquist | 128/206.25 |
| 4,215,437 | A | * | 8/1980 | Kao | 128/201.16 |
| 4,402,316 | A | * | 9/1983 | Gadberry | 128/201.15 |
| 4,572,178 | A | * | 2/1986 | Takase et al. | 128/201.25 |
| 4,590,951 | A | * | 5/1986 | O'Connor | 128/201.25 |
| 4,595,003 | A | * | 6/1986 | Shoemaker et al. | 128/201.19 |
| H000397 | H | * | 1/1988 | Stark | 128/206.24 |
| 4,739,755 | A | * | 4/1988 | White et al. | 128/206.12 |
| 4,771,771 | A | * | 9/1988 | Walther | 128/201.25 |
| 4,787,925 | A | * | 11/1988 | Ansite | 128/201.25 |
| H000863 | H | * | 1/1991 | Kwiedorowicz et al. | 128/201.23 |
| 5,140,980 | A | * | 8/1992 | Haughey et al. | 128/201.25 |
| H001316 | H | * | 6/1994 | McGuinness | 128/201.15 |
| H001360 | H | * | 10/1994 | Grove et al. | 128/201.23 |
| H001361 | H | * | 10/1994 | Tardiff et al. | 128/206.12 |
| 5,357,947 | A | * | 10/1994 | Adler | 128/201.13 |
| 5,394,870 | A | * | 3/1995 | Johansson | 128/201.25 |
| 5,431,156 | A | * | 7/1995 | Sundstrom | 128/201.23 |
| 5,452,712 | A | * | 9/1995 | Richardson | 128/201.22 |
| 5,499,624 | A | * | 3/1996 | Kruger et al. | 128/204.26 |

(Continued)

FOREIGN PATENT DOCUMENTS

EP 0164946 * 12/1985

(Continued)

OTHER PUBLICATIONS

Barrett, et al "Aerosol Loading Performance of Electret Filter Media", AIHA Journal 59:532-539 (1998).

*Primary Examiner*—Mital Patel
(74) *Attorney, Agent, or Firm*—Ulysses John Biffoni

(57) ABSTRACT

An improved crew mask for protection of a user against chemical and biological hazards is provided. The novel crew mask includes the following features: a facepiece that includes a hybrid face seal with both intern and flat seals, and at least one transparent lens positioned at the level of the eyes of the person; at least one inlet hose for delivery of filtered air operably connected to the facepiece; at least one exhaust one-way exhaust port for venting air from the crew mask; and a compact filter unit with a reduced airflow resistance relative to currently employed filter units.

13 Claims, 2 Drawing Sheets

U.S. PATENT DOCUMENTS 5,549,104 A * 8/1996 Crump et al. ..... 128/201.25
5,653,225 A * 8/1997 Schegerin ..... 128/201.22
5,664,566 A * 9/1997 McDonald et al. .... 128/205.25
5,666,949 A * 9/1997 Debe et al. ..... 116/206
6,158,429 A * 12/2000 Gardner et al. ..... 128/201.25
6,176,239 B1 * 1/2001 Grove et al. ..... 128/201.15
6,328,031 B1 * 12/2001 Tischer et al. ..... 128/201.22

FOREIGN PATENT DOCUMENTS

GB 2222778 A * 3/1990

* cited by examiner

ADVANCED CHEMICAL/BIOLOGICAL CREW MASK

GOVERNMENT INTEREST

The invention described herein may be manufactured, licensed, and used by or for the U.S. Government.

FIELD OF THE INVENTION

The present invention pertains to air purifying masks suitable for use in contaminated or potentially contaminated military environments, and especially for use by crewpersons operating or present in military vehicles.

BACKGROUND OF THE INVENTION

Air purifying respiratory protective devices currently used by the military for protection against chemical and biological contaminants impose a substantial physiological burden on the wearer. These respirators (masks) are difficult to wear for prolonged periods because they are relatively bulky and heavy, have high breathing resistance, impair vision and communications, cause thermal stress, physical discomfort, and degrade job performance. The demands placed on respiratory protection equipment for use by the crews of military vehicles: e.g., land and/or sea vehicles and aircraft, are even greater, due to the limitations on the size or bulk of such crew masks in crowded crew cabins, and the need to avoid fogging of the lenses, and crew person exhaustion from heat buildup, physical discomfort and/or respiratory effort.

Thus, crew mask respirator systems for protecting vehicle crews must be optimized for minimal bulk and weight, in order to readily fit within the limited crew space provided. In addition, crew masks must be optimized to provide a sufficient flow of purified air for respiration and comfort, e.g., minimizing lens fogging, heat stress, respiratory effort and excessive pressure by the mask seals on contacted parts of the face and/or head.

Previous efforts to provide crew masks include the U.S. Army M45 (Aircrew) and M42 (Combat Vehicle) masks. These masks use a standard six point suspension system and an intern periphery design. The artisan will appreciate that an "intern" periphery provides that the contact point/seal between the mask and the skin of the user is provided by an inwardly turned mask edge. However, the M45 has no powered blower system due to weight and logistic concerns. While the M45 provides adequate unblown protection and defogging properties, this crew mask is reported to be very uncomfortable when used in combination with helmet systems, e.g., aircrew helmets, due to the harness buckles and the presence of the intern seal in the forehead area, where a crew helmet can press the seal into the forehead. In addition, the lack of a powered blower system results in high breathing resistance, adding to crew fatigue.

In an alternative approach, the U.S. Air Force AERP mask system eliminates the face seal, in favor of a neck seal design. In addition, both the U.S. Army M48/M49 and the U.S. Air Force AERP use a dual canister blower system for providing the overpressure needed for protection against inward diffusion of toxic agents, and to provide additional airflow for keeping the lenses free of moisture or fog. Existing blowers are built to provide for air flow rates of approximately 4 cubic feet per minute CFM and attendant overpressure. Given the need for an air flow of approximately 4 CFM, the presently employed blowers for all current crew mask systems are sub-optimal in size and bulk.

Thus, there remains a need in the art for a crew mask for protection against chemical or biological toxic agents that provides a comfortable face seal and helmet interface and an optimized size and bulk of the equipment, while still providing adequate protection and defogging in the confines of a vehicle.

SUMMARY OF THE INVENTION

In order to solve these and other problems in the art, the present invention provides a hybrid intern and flat seal approach to allow for a very comfortable face and helmet interface, while still providing adequate unblown protection and defogging capacity. The face seal is flat, i.e. a feathered edge, at the part of the mask that seals against the forehead, but is an intern (inwardly curved) seal on the remainder of the mask. Further, the crew mask according to the invention uses a reduced backpressure, "breathe-through" filter canister and blower designed to reduce overall blower weight and bulk. The breath-through design also advantageously permits a crewperson to breath filtered air with less effort than do the presently available crew masks, in the event that the powered blower fails to operate.

Thus, the invention provides a crew mask for protection of a user against chemical and biological hazards that includes, for example, (a) a facepiece having a hybrid face seal, said hybrid face seal comprising an intern seal adapted to surround and seal the user's chin, nose and mouth, and a flat seal adapted to extend on both sides of the user's face up to and across the user's forehead;

(b) at least one transparent lens attached to said facepiece and adapted to be positioned at the level of the eyes of the user;

(c) at least one inlet connection in said facepiece adapted to connect to a hose for delivery of filtered air;

(d) at least one, one-way exhaust port in said facepiece for venting air from said crew mask; and (e) a compact filter unit connected to said facepiece for providing filtered air to said inlet connection.

The hybrid face seal includes an intern seal surrounding and sealing the user's chin, nose and mouth, and a flat seal extending on both sides of the user's face up to and across the user's forehead. The crew mask also optionally includes a hard shell positioned on the outside of the crew mask.

The crew mask also optionally includes a hood suitable for wearing comfortably under a crew helmet, wherein the hood holds the crew mask against a crewperson's face. The hood is attached to the crew mask at a location that can include the periphery of the crew mask adjacent to the transparent lens. In addition, the crew mask, with hood, optionally includes a horizontal or neck strap across the back of the hood, positioned so that the strap extends forward to attach to each side of the crewmask, so that the part of the mask that includes the chin, nose and mouth covering is held tightly against the face of the wearer by the neck strap.

Preferably, the compact filter unit has an airflow resistance of about 10 mm to about 30 mm of water at an airflow rate of about 85 liters per minute. The compact filter unit, which is optionally two-sided for optimum use of space, includes a particle filter element, e.g., a HEPA filter, an electrostatic or electret filter and combinations thereof. For optimum efficiency and wearer comfort, the particle filter is an electret type filter with a filtration efficiency similar to that of a HEPA filter element, when measured at an airflow of 50 liters per minute. The compact filter element also optionally includes a material effective to remove undesirable chemical vapors, e.g., toxic vapors such as nerve gases or agents. Preferably, for use against organic or organophosphate type toxic vapors or agents, this is a packed-bed" carbon filter. Optionally, other art-known adsorbents are included with and/or substituted for the packed bed carbon filter when other vapor threats are present. Where practicable, the crew mask is blower assisted, and the blower provides an air flow ranging from about 0.5 to about 2.0 CFM.

DETAILED DESCRIPTION OF THE PREFERRED EMBODIMENT

Broadly, the invention provides crew masks for protection against chemical and/or biological toxic agents having a compact design that provides improved comfort for helmeted crew members, and reduced airflow requirements in embodiments designed to employ powered blowers. In addition, the invention provides for a compact and free-flowing filter material for removing undesirable chemical vapors/toxins from the breathing air. Preferably, this is in the form of a novel "packed-bed" carbon filter allowing improved airflow for respiration and defogging relative to present filter materials. This is particular advantageous in those embodiments without powered blowers, or in situations where the powered blower has failed or lost electrical power. Thus, by reducing the airflow requirements of crewmasks according to the invention, and by reducing the airflow resistance through the filter element(s), there is a reduced breathing effort for unassisted respiration by a crewperson, and power assisted crewmasks require less airflow, and therefore smaller, less bulky blowers, than do previous models. The result is a lighter, more compact, less bulky crewmask, with or without a powered blower to assist breathing.

A. The Facepiece and Seals

The crew masks according to the invention provide an improved and closer fit against the face, resulting in a smaller air space adjacent to the face. This smaller air space requires less airflow to ventilate and remove accumulated heat and moisture, relative to previous masks. In addition, the full intern periphery seal design heretofore employed in crew masks has been reported to press on the forehead with an unacceptable level of pressure, particularly with a crew helmet pressing thereon. Thus, the crew masks of the invention are constructed with a hybrid face seal: an intern periphery seal where the mask contacts the lower part of the face, around the chin, mouth and nose, and a flat seal along the upper part of the mask, adjacent to and in contact with the forehead of a person wearing the mask.

Figure 1A:
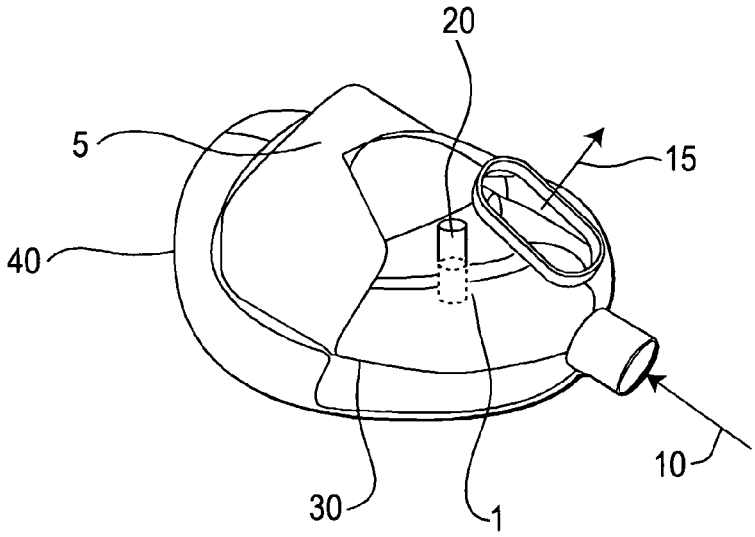
FIG. 1A illustrates the front of the crew mask according to the present invention, in oblique view.
Figure 1B:
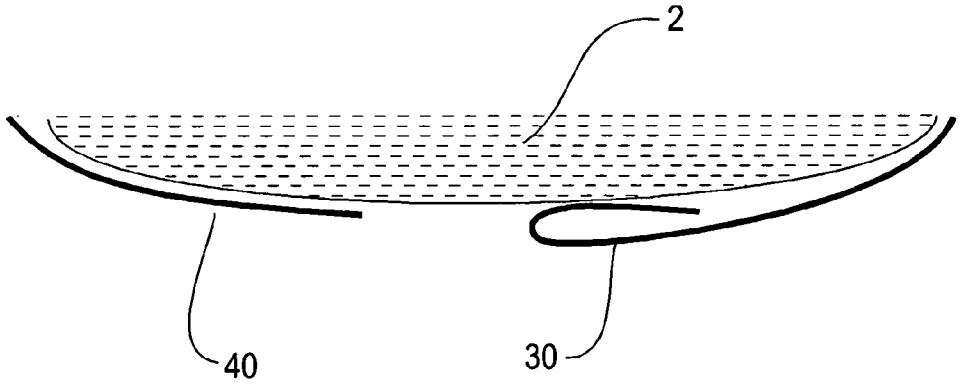
FIG. 1B illustrates an edge view of an flat seal and an intern seal against a facial surface of a crew person.
Figure 2:
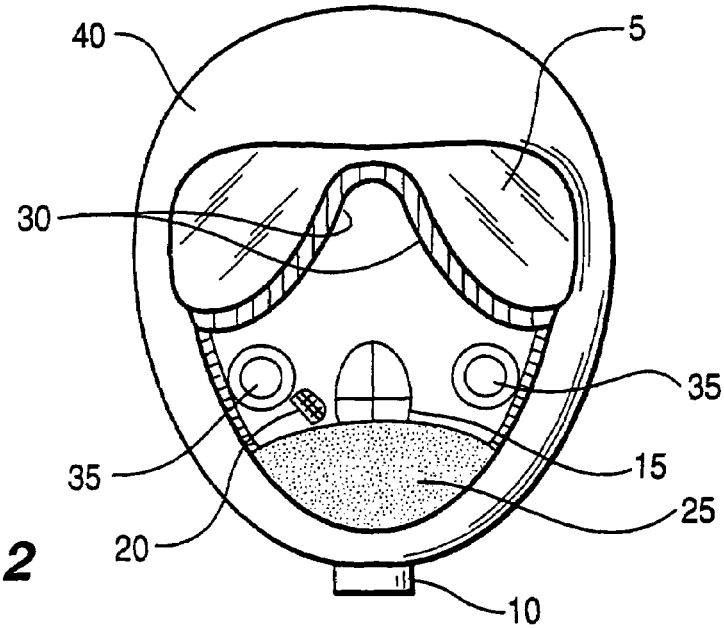
FIG. 2 shows a schematic of the inside of the crew mask according to the present invention.

The artisan will better appreciate the novel features and embodiments of the invention by referring to FIGS. 1A, 1B and 2. The facepiece (1) is designed to have a profile that fits as close to the face (2) as possible. A foam insert is optionally positioned under the temple suspension to improve the fit for individuals with narrow faces. Overall, the facepiece ranges from about 0.045 to about 0.075 inches in thickness. Preferably, the facepiece thickness is about 0.060 inches.

In one embodiment, the facepiece is flexible and is molded from a silicone/organic rubber blend. Although other silicone and organic rubber materials (i.e., silicone, EPDM, butyl, thermoplastic elastomer) could be used, these materials offer the best overall properties for a flexible facepiece.

In a second embodiment, a hard shell is positioned over or outside of the elastomeric facepiece to provide added rigidity and protection from impact and/or flying debris and the like. This rigid shell is optionally bonded to the elastomeric facepiece and/or mechanically attached thereto. Preferably, the shell dimensions are selected to be slightly smaller than the facepiece, i.e., leaving the flexible facepiece uncovered around the periphery of the crewmask. For example, such a peripheral flexible border around the crew mask will range in width from about 0.25 to about 1.50 inches, to allow the seal to be free to bellow, that is, to make a flexible contact with the face.

Advantageously, when the hard shell is incorporated into the crewmask to cover the facepiece, this protective shell also allows for secure attachment of the crew mask to other protective equipment. Simply by way of example, the shell is readily attached to a chemical/biological hood, either with or without a neck seal, as desired. The hard shell is also optionally attached to the helmet, for increased stability, by any art standard method, e.g., snaps, straps, hook and loop connectors (e.g., Velcro™ or the like) to the helmet. Preferably, a stable and operable connection between the hard shell and helmet is made with a dual bayonet or ratchet connection system similar to that used on oxygen masks employed in fixed wing aircraft.

The artisan will appreciate that the hard shell is made of any suitable rigid material(s), such as a thermoplastic polymer and/or copolymer or composite material. Simply by way of example, suitable art-known polymer materials for the hard shell include polycarbonates, acrylics, polystyrenes, high density polyethylenes, and the like. Fiber-polymer composites are also contemplated for use in the manufacture of the hard shell. These include, for example, polymer or copolymer composites, such as epoxy polymers, that are reinforced with fiberglass, graphite fiber, aramid fiber, and/or combinations of these, or similar materials. The hard shell can also be manufactured from lightweight metal alloy(s), including aircraft aluminum, and the like, and any other suitable art-known materials. The durometer of the facepiece ranges, for example, from about 20 to about 60 Shore A hardness, but more typically has a hardness of 30 Shore A.

With or without a hard shell, the facepiece allows for the incorporation of all required or optional components of the crew mask. The lens (5) is manufactured from any optically suitable transparent barrier material. The desirable properties of the selected lens material are that it be optically clear, shatter and abrasion resistant, distortion free, and optionally capable of use with weapon sighting systems. Simply by way of example, the lens is made from any suitable transparent polycarbonate, acrylic, epoxy polymer or copolymer, etc. Preferably, the lens comprises a polycarbonate. Aircrew helmet visors have typically been produced from polycarbonate material meeting the requirements of MIL-V-43511 and Fed. Spec. L-P-393. Polycarbonate is noted for its clarity, high impact strength and dimensional stability. It molds well, with very low shrinkage. Numerous grades of polycarbonate material are commercially available and can be obtained with the optimum blend of physical properties, including flame and abrasion resistance. Abrasion resistance can be further enhanced with the use of a protective coating in accordance with MIL-C-83409.

One suitable polycarbonate is an allyl diglycol carbonate that is commercially available as CR39™ from Pittsburg Plate Glass Ind. (Pittsburg, Pa.). Even more preferred is are optical quality polyurethanes that are formed into a desired lens shape, e.g., by casting. One preferred type of optical quality polyurethane is commercially available from Simula Technologies Inc., Phoenix, Ariz. Designators include, simply by way of example, the Sim 10, Sim 14, and Sim 2000 grades, which vary by stiffness or flexibility. Sim 2000 is the stiffest or least flexible of this series, but Sim 14 is preferred.

Optionally, the lens incorporates filter or partial reflective elements to reduce the transmission of undesirable wavelengths, e.g., ultraviolet, infrared or polarized visible light associated with reflective glare. Such filter or reflective elements can be present at a preset level and/or in the form of a light or heat responsive coating, i.e., a photochromic and/or thermochromic coating or filter that darkens in the presence of undesirable levels of light and/or thermal radiation.

The facepiece also provides connections for at least one inlet hose for delivery of filtered air (10). An optional voice port (15) comprising an art-standard voice transmitting, but gas-impermeable membrane is provided, positioned so as to be adjacent to the mouth of the crew person. In addition, provision is made to pass an optional wired or wireless electronic voice pickup microphone through the facepiece so that intra-vehicle and/or long range communications can be maintained. This is optionally a simple elastic port (20) through which an electrical or electronic cable is force fit, or in another option, is in the form of a narrow diameter tube bonded to the facepiece, through which a cable is securely placed.

The crew person's nose and mouth are securely covered by an internal breathing mask, defined by a chin cup in the form of an expanded intern seal (25) suitably positioned underneath the facepiece to contact and cradle the chin. The remainder of the internal breathing mask securely surrounds a crew person's oral-nasal face below the lens. Thus, the intern seal chin cup extends in the form of an intern seal (30) up both sides of the oral-nasal face and across the face below the lens. In this form the vital respiratory openings of the nose and mouth are protected from the environment by an intern seal.

Art-standard one-way exhaust port(s) (35) are positioned at the front of the internal breathing mask, within the circumference of the intern seal to pass exhaled/exhaust air through the facepiece. Two exhaust ports are illustrated in FIG. 2, but the artisan will appreciate that the actual number employed can be readily varied, from one to 4 or more, depending on need. Optionally, in certain embodiments, the exhaust air is continuously or intermittently sampled or monitored for work-load indicators such as, e.g., $CO_2$, $H_2O$, temperature, and/or $O_2$ concentration/partial pressure using art-standard detectors for these parameters. Such optional detectors are positioned, for example, in the airstream of one or more of the exhaust ports and are optionally connected to art-standard recording devices and/or telemetry devices, for recorded or real time crew status monitoring. In a further option, one or more of the detectors mentioned supra are operably connected to a computerized control system providing for optimal regulation of blower power levels. This later embodiment might be employed to automatically minimize blower power demands without distracting the crew person, under conditions in which management of battery power resources is critical.

In a further optional embodiment, in the environment of a vehicle crew compartment, the exhaust air is not released directly from the crew mask, but the exhaust port(s) are connected by a hose or conduit to the outside of the vehicle. In this way the buildup of humid respiratory air and/or heat buildup within a crew compartment is minimized. In a further still embodiment, the crew mask(s) include optional adapters, e.g., bayonet-type connectors, that can be connected to an internal supply of breathing gas for situations where environmental air is simply unbreathable due to, e.g., high altitude, local atmospheric oxygen depletion or the presence of toxins that the filter system cannot exclude. Breathing gas supplied by such optional connectors can range in composition, for example, from breathing grade oxygen, to compressed air or equivalent nitrox mixtures.

While the internal mask is bounded by an intern seal, the full outer circumference of the crew mask is bounded by a flat seal (40). Above the lens (5) the flat seal is the only seal for the forehead area, where it is positioned to contact and seal the sides and top of the crewperson's forehead. This arrangement provides a significant improvement in comfort by providing a hybrid seal system which allows for the most comfortable and effective type of seal for each part of a crew person's face. In particular, the flat forehead seal eliminates the discomfort experienced by a crewperson when a helmet forces an intern seal to dig into the forehead. Below the lens, the flat seal provides some redundant sealing outside the circumference of the intern seal. This is helpful because the oral-nasal part of the face, which mobile during speech, etc. is often more difficult to seal.

The mask components mentioned supra can be either integrally molded, insert molded, snapped, or bonded into the full crew mask. Bonding has been demonstrated with silicone adhesives.

The crew masks according to the invention are readily worn using any art-standard harness system, for example, the art-known six point strap harness. However, in a further alternative embodiment, the crew masks according to the invention are advantageously suspended by a headpiece or hood, which functions as a relatively more comfortable helmet liner, while holding the crew mask in place. This later arrangement avoids the discomfort of having one or more mask straps passing under a crew helmet, so that such mask straps are pressed into the scalp by the weight of the helmet.

B. The Blower and Filter(s)

While the crew mask of the invention is designed to be usable without the assistance of mechanical airflow, where practicable crew effort and comfort are enhanced by the assistance of a forced air supply. The mask is readily employed with a forced airflow ranging, e.g., from about 0.5 to about 2 CFM. While greater air flow rates may be optionally employed, this will lead to an increase in the weight, bulk and power requirements for the blower. Thus, for optimal use under field conditions, the airflow is preferably no greater than 2 CFM.

Figure 3A:
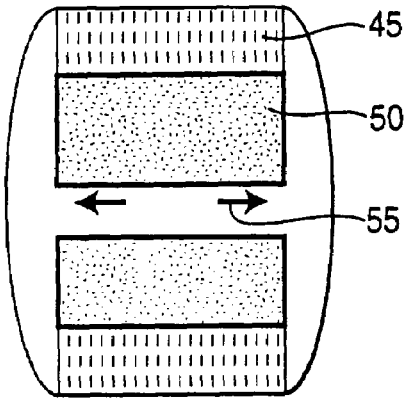
FIG. 3A shows a cross section of a two-sided filter.
Figure 3B:
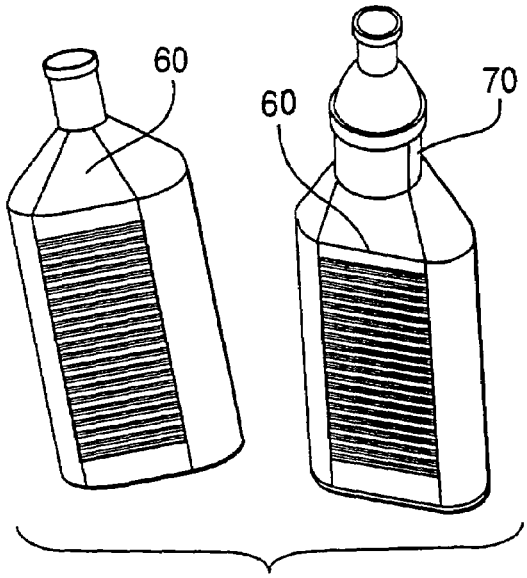
FIG. 3B shows a filter unit with and without the optional blower.

Preferably, whether or not the optional blower is employed, there are two filters (each a mirror image of the other) positioned on opposite sides of filter unit, so as to minimize bulk and volume. FIG. 3A is a cross-section of the preferred two-sided filter. The air flows into the filter from the top and bottom (entering through a particulate filter (45), then passes through a sorbent filter (50), then the filtered air exits from the central conduit or air passage (55) (as indicated by the arrows). Filters preferably include, without limitation, a sorbent structure, a particulate filter, and a thermoplastic binder or silicone adhesive. FIG. 3A depicts a cut-away or cross-section of the filter media.

A particulate filtration media (45) is preferably included along with the moldable sorbent structure. The particulate filtration media is made of any material suitable for trapping fine dust, bacteria, spores and the like, with a relatively low breathing resistance or back pressure. While a high efficiency particulate air ("HEPA") filter element is readily employed, an electret or electrostatic filtration media, that is, a filter material with fibers comprising a permanent electric potential, for example, such as filters commercially available from 3M®, may also be used. In the preferred embodiment, 3M® electrostatic media is preferably employed for its reduced breathing resistance relative to HEPA-type filters of the same filtration rating and surface area. The electret filtration media is preferably optimized to provide HEPA performance at a depth of approximately 0.1 inches. The surface area of the particulate filter should be a minimum of 125 $cm^2$ to 150 $cm^2$ for optimal filtration with a low backpressure.

Simply by way of example, the preferred electret filter material passes a test protocol measured against a standardized aerosol. The standardized aerosol has a particle size distribution with a count mean diameter (CMD) of 0.185+/−0.02 micrometers and a geometric standard deviation of 1.60. Penetration is measured at 50 liters per minute (about 1.76 CFM. Each specimen is challenged with a concentration not to exceed 200 milligrams per cubic meter. The test proceeds until minimum efficiency is achieved or until an aerosol mass of at least 200+/−5 mg has contacted the filter. Current military mask standards call for 99.99% efficiency using this test.

Particular 3M® electric filter materials suitable for use in the instant crewmask include, for example, those designated as AEM 2, AEM 3, and AEM 4. AEM 2 provides HEPA level filtration with reduced backpressure relative to equivalent mechanical HEPA level filtration materials, and AEM3 and 4 add improved performance in the presence of aerosols that include oil. Several of these materials are described in the literature, see, for example, Barrett et al., 1998, *AIHA Journal* 59:532–539, incorporated by reference herein, which discusses tribocharged polypropylene/acrylic, corona charged polypropylene, fibrillated electret film, and new advanced electret media which the authors compared with mechanical filter media using aerosol filtration tests designed for particulate respirators.

The sorbent structure (50) is made of a moldable carbon bed. This structure is made, for example, by bonding activated carbon granules (i.e. Calgon ASZM-TEDA™ carbon) using a thermoplastic binder material such as polyurethane. Other sorbents and thermoplastic binders are readily employed. This bonding ratio (typically 10–20%) must be optimized for both ruggedness and vapor sorption performance. Bed depths range, for example, from about 0.5 inches to about 1.0 inch, based on the performance requirements of the system. Filtered air flows out of the air gap (55) between the two opposite facing filter elements.

In a preferred embodiment, the sorbent structure and particulate media are bonded into a plastic housing (60) to provide the filter portion of the unit. This bonding can be accomplished, for example, with a silicone adhesive sealant or a thermoplastic edge seal adhesive. Optionally, as mentioned supra, a blower (70) is built into the housing.

In a further optional embodiment, a blower is operably connected to the filters, either within or external to the filter housing. Depending on the desired configuration, the blower is positioned distal to the filter unit, relative to the crewmask, so as to force air into the filter. Alternatively, the blower is positioned proximal to the filter unit, relative to the crewmask, so as to create a partial vacuum that results in a flow of ambient air through the filter. The optional blower includes any suitable low profile fan, impeller, rotary air pump or the like, but preferably the blower includes a single axial fan system designed to minimize the overall profile of the blower. Generally, the blower is electrically powered, e.g., by low voltage direct current provided by a vehicle system and/or a portable power supply that comprises primary (disposable) or secondary (rechargeable) batteries, and/or any suitable portable source of electrical power, e.g., a fuel cell device. The low voltage direct current ranges, e.g., from about 6 to about 24 volts, depending upon the standard power supply of the vehicle, and/or the desired weight and configuration of a power pack carried by a crew person. Alternative motive power for the blower can include, e.g., a vehicle engine vacuum system configured to turn the blower fan. The filter blower structure incorporates a rigid plastic housing that can be injection molded from any engineering plastic.

What is claimed is:

1. A crew mask for protection of a user against chemical and biological hazards, comprising:

(a) a facepiece having a hybrid face seal, wherein said hybrid face seal comprises a single continuous seal having an intern seal adapted to surround and seal the user's chin, nose and mouth, contiguous with and transitioning into a flat seal adapted to extend on both sides of the user's face up to and across the user's forehead;

(b) at least one transparent lens attached to said facepiece and adapted to be positioned at the level of the eyes of the user;

(c) at least one inlet connection in said facepiece adapted to connect to a hose for delivery of filtered air;

(d) at least one, one-way exhaust port in said facepiece for venting air from said crew mask; and (e) a compact filter unit connected to said facepiece for providing filtered air to said inlet connection.

2. The crew mask of claim 1, wherein said compact filter unit has an airflow resistance of about 10 mm to about 30 mm of water at an airflow rate of about 85 liters per minute.

3. The crew mask of claim 1, wherein said compact filter unit includes a particulate filter element.

4. The crew mask of claim 3, wherein said particulate filter element is selected from the group consisting of a HEPA filter, an electret filter, an electrostatic filtration media, and combinations thereof.

5. The crew mask of claim 3, wherein said particulate filter element is equivalent in filtration efficiency to a HEPA filter element as measured at an airflow of 50 liters per minute.

6. The crew mask of claim 1, wherein said compact filter unit includes a material effective to remove undesirable chemical vapors.

7. The crew mask of claim 6, wherein said material effective to remove chemical vapors comprises a packed-bed carbon filter.

8. The crew mask of claim 1, wherein said compact filter unit includes a two-sided filter element.

9. The crew mask of claim 1, wherein said compact filter unit is blower assisted, and said blower provides an airflow ranging from about 0.5 to about 2.0 CFM.

10. The crew mask of claim 1, further comprising a hard shell positioned on an outside surface of said facepiece.

11. The crew mask of claim 1, further comprising a port for connecting a source of breathing oxygen to said crew mask.

12. The crew mask of claim 1, further comprising a hood suitable for wearing under a crew helmet, wherein said hood holds said crew mask against a user's face.

13. The crew mask of claim 12, wherein said hood is attached to said crew mask at a location comprising the periphery of the crew mask adjacent to said transparent lens.

* * * * *